United States Patent [19]

Yoshizawa

[11] Patent Number: 4,704,343

[45] Date of Patent: Nov. 3, 1987

[54] ELECTROPHOTOGRAPHIC PHOTOSENSITIVE MEMBER CONTAINING AMORPHOUS SILICON AND DOPED MICROCRYSTALLINE SILICON LAYERS

[75] Inventor: Shuji Yoshizawa, Tokyo, Japan

[73] Assignee: Kabushiki Kaisha Toshiba, Kawasaki, Japan

[21] Appl. No.: 3,397

[22] Filed: Jan. 14, 1987

[30] Foreign Application Priority Data

Feb. 26, 1986 [JP] Japan ..... 61-40705
Feb. 26, 1986 [JP] Japan ..... 61-40707
Feb. 26, 1986 [JP] Japan ..... 61-40708

[51] Int. Cl.[4] ..... G03G 5/08
[52] U.S. Cl. ..... 430/66; 430/132
[58] Field of Search ..... 430/66, 67

[56] References Cited

U.S. PATENT DOCUMENTS 4,560,634 12/1985 Matsuo et al. ..... 430/128 X
4,582,773 4/1986 Johncock ..... 430/64 X

*Primary Examiner*—J. David Welsh
*Attorney, Agent, or Firm*—Schwartz, Jeffery, Schwaab, Mack, Blumenthal & Evans

[57] ABSTRACT

An electrophotographic photosensitive member has high sensitivity with respect to long-wavelength light, since it is formed of amorphous silicon containing hydrogen. A surface layer has excellent charge-retaining properties, since it is formed of microcrystalline silicon containing at least one element selected from the group consisting of carbon, nitrogen, and oxygen. A barrier layer is formed of boron nitride or of microcrystalline silicon containing at least one element selected from among those of Group III or V of the periodic table. The BN barrier layer has high resistivity and high blocking properties. The μc-Si barrier layer is of p-type or n-type, due to the doping of a Group III or V element, and has a rectifying function.

6 Claims, 3 Drawing Figures

ELECTROPHOTOGRAPHIC PHOTOSENSITIVE MEMBER CONTAINING AMORPHOUS SILICON AND DOPED MICROCRYSTALLINE SILICON LAYERS

BACKGROUND OF THE INVENTION

This invention relates to an electrophotographic photosensitive member for electrophotography, and a method of manufacturing the same.

Until now, an electrophotographic photosensitive member or a photoreceptor has been prepared from inorganic materials such as CdS, ZnO, Se, Se-Te or amorphous silicon or organic materials such as poly-N-vinylcarbazole (PVCZ) or trinitrofluore (TNF). However, these conventional photoconductive materials have presented various difficulties in manufacturing the subject product. Consequently, these materials have been selectively used in accordance with the intended object with some lack of performance of the desired properties of a photosensitive system.

For example, Se and CdS are harmful to the human body, demanding particular care in manufacturing, from the point of ensuring safety. Therefore, these materials are accompanied with the drawbacks that the manufacturing phase involves a complicated process, resulting in a high manufacturing cost and high recovery costs due to the required recovery of Se. Moreover, the Se and Se-Te series have as low a crystallization temperature as 65° C. Therefore, when copying is repeated, difficulties arise with respect to the photoconductive property, for example, in residual potential. Consequently the Se and Se-Te series have a short effective life and are reduced in practicability.

Moreover, ZnO easily undergoes oxygen reduction, and is noticeably affected by exposure to the atmosphere, and has a low reliability in application.

Further, organic photoconductive materials such as PVC and TNF are suspected to be carcinogens. These materials present difficulties from the point of view of safety to the human body, and, what is worse, are handicapped by low thermal stability, abrasion resistance and a short effective life, as is characteristic of organic materials.

On the other hand, amorphous silicon (hereinafter abbreviated as "a-Si") has recently attracted wide attention as a photoelectric converting material and has been successfully applied for use in a solar cell, thin film transistor and image sensor. Description may now be made of the application of a-Si as the photoconductive material of an electrophotographic photosensitive member (Japanese patent disclosure No. Sho 59-12448). Offering the advantages that it is harmless and need not be recovered, a-Si has a higher spectroscopic sensitivity in the region of visible rays than other materials, and has a great resistance to abrasion and impact due to its significant surface hardness.

Research has been done on a-Si as a photoreceptor for electronic photography, based on the Carlson process. In this case, a photosensitive material with high resistance and photosensitivity is required. Since, however, difficulties are presented in causing a single layer photosensitive element to satisfy both requirements, the conventional practice is to provide a barrier layer between the photoconductive layer and conductive support and deposit a surface charge-retaining layer on the photoconductive layer and try to meet the above-mentioned requirements with the resultant laminate structure.

Description may now be made of a-Si. Generally, this material is manufactured by the glow discharge decomposition process involving the application of silane series gas. In this case, hydrogen is carried into the a-Si layer. Electrical and optical properties noticeably vary with the content of hydrogen. Namely, the greater the quantity of hydrogen carried into the a-Si layer, the more enlarged the optical band gap, and consequently the resistance of the a-Si layer is raised. Since the a-Si layer is more reduced in sensitivity to the light rays having long wavelengths, it is difficult to practically utilize a semiconductor laser beam printer equipped with, for example, a semiconductor laser device. In case the a-Si layer contains much hydrogen, it sometimes happens that the greater part of the layer is occupied, for example, by a structure consisting of $(SiH_2)n$ bonded with $SiH_2$. In such case, voids are noticeably generated, and silicon dangling bonds are increasingly produced. Such an event causes the photoconductive property of the a-Si layer to be so reduced as to fail to serve an electrophotographic photosensitive member, i.e., a photoreceptor. If, conversely, smaller quantities are taken into the a-Si layer, the optical band gap is reduced and decreases in resistance, but increases in the sensitivity to light rays having long wavelengths. The conventional a-Si layer, manufactured by the customary film-forming process, has the drawbacks that if it decreases in hydrogen content, it tends to be coupled with silicon dangling bonds, resulting in a decrease in the content of hydrogen, which is desired to minimize said coupling. Therefore, the drawbacks arise that generated carriers drop in transmission speed and have a reduced life, leading to the deterioration of the photoconductivity property of the a-Si layer, thereby rendering said a-Si layer unusuable as an electrophotographic photosensitive member.

In this connection, description may now be made of the process of elevating the sensitivity of the a-Si-layer to light rays having long wavelengths. This process comprises the steps of mixing a silane-series gas with germane $GeH_4$, applying glow discharge decomposition, and producing a layer having a narrow optical band gap. Generally, however, silane-series gas and $GeH_4$ have different optimum substrate temperatures, resulting in the occurrence of structural defects in the resultant layer and the failure to provide a satisfactory photoconductive property. The spent gas of $GeH_4$, if oxidized, will be converted into a noxious gas. Therefore, the treatment of the exhausted $GeH_4$ gas involves complicated steps. Consequently, the above-mentioned process involving the mixture of silane series gas and germane gas ($GeH_4$) lacks practicability.

SUMMARY OF THE INVENTION

It is an object of the present invention to provide an electrophotographic photosensitive member having excellent charging properties, low residual potential, high sensitivity over a wide wavelength range up to a near infrared ray range, good bonding properties with relation to a substrate, and excellent environmental resistance.

According to the present invention, an electrophotographic photosensitive member comprises:

a conductive substrate;

a photoconductive layer of amorphous silicon containing hydrogen;

a barrier layer provided between the conductive substrate and the photoconductive layer; and a surface layer of microcrystalline silicon containing at least one element selected from the group consisting of nitrogen, carbon, and oxygen, formed on the photoconductive layer.

In this invention, since a photoconductive layer is formed of amorphous silicon containing hydrogen, it has a high sensitivity to long-wavelength light.

Since a surface layer is formed of microcrystalline silicon (to be referred to as a μc-Si hereinafter) containing at least one element selected from the group consisting of nitrogen N, carbon C, and oxygen O, it has excellent charge-retaining properties. The photoconductive layer can be of a function-separation type, which is separated into a charge-generation layer for generating carriers upon irradiation of light, and a chargetransfer layer for transferring the carriers to a conductive substrate, through a barrier layer.

The barrier layer can be formed of boron nitride (BN) or of μc-Si containing at least one element selected from among those of Group III or V of the periodic table.

The barrier layer made of BN has high resistivity and good blocking properties, and also strongly bonded with the substrate. On the other hand, the barrier layer of μc-Si is of p-type or n-type due to the doping of a Group III or V element. Thus, a barrier layer having excellent rectifying properties can be obtained, according to the present invention. If the μc-Si barrier layer contains at least one element selected from the group consisting of C, N, and O, it has high resistivity and high charge-retaining properties.

Note that μc-Si is clearly differentiated from a-Si and polyerystalline silicon, by the following physical properties:

More specifically, upon X-ray diffraction measurement, since a-Si is amorphous, only a halo appears, and no diffraction pattern can be detected. On the other hand, μc-Si exhibits a diffraction pattern in which $2\theta$ is near 28 to 28.5°. Polycrystalline silicon has a dark resistance of $10^6$ Ω·cm, while μc-Si has a dark resistance of $10^{11}$ Ω·cm or more. The μc-Si is constituted by microcrystals having a particle size of several tens of angstroms or more.

DETAILED DESCRIPTION OF THE PREFERRED EMBODIMENTS

A first embodiment of the present invention will now be described with reference to the accompanying drawings.

Figure 1:
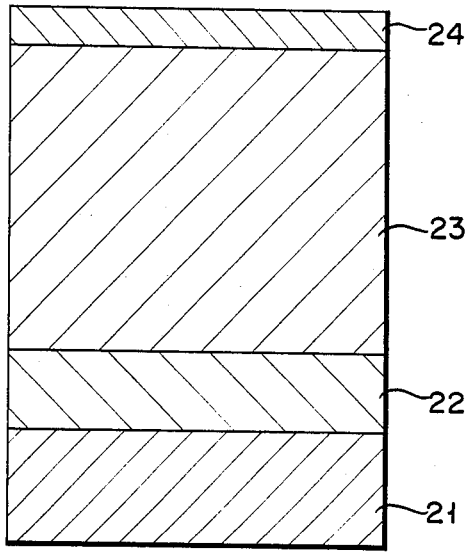
FIG. 1 is a sectional view showing an electrophotographic photosensitive member according to a first embodiment of the present invention.

FIG. 1 is a partial sectional view of an electrophotographic photosensitive member according to the first embodiment of the present invention. Barrier layer 22 is formed on conductive substrate 21, for example, an aluminum substrate, and photoconductive layer 23 is formed on layer 22. Surface layer 24 is formed on layer 23. Layer 22 is formed of amorphous boron nitride (to be referred to as a-BN hereinafter). Photoconductive layer 23 is formed of a-Si containing 1 to 10 atm. % of hydrogen on barrier layer 22. The surface layer is formed of μc-Si containing at least one element selected from the group consisting of C, O, and N.

Barrier layer 22 restricts the flow of carriers (electrons or holes) from the conductive substrate to the photoconductive layer, thereby enhancing the chargeretaining function of the electrophotographic photosensitive member, and hence, its charging properties. In this embodiment, barrier layer 22 is formed of a-BN, which is normally amorphous and contains hydrogen. This a-BN is similar to an intrinsic semiconductor (i-type) and has high resistance. The a-BN has good bonding properties with the conductive substrate. The barrier layer preferably has a thickness of 0.01 to 10 μm.

Photoconductive layer 23 is formed of a-Si, and preferably contains 1 to 10 atm. % of hydrogen. The photoconductive layer ideally has no trap for trapping carriers. However, if the silicon layer is not monocrystalline, it has a certain degree of irregularity and dangling bonds. In this case, if the layer contains hydrogen, hydrogen ions serve as a terminator of the silicon dangling bonds, and compensate therefor, thus improving the carrier-transfer properties. The hydrogen content is preferably 1 to 10 atm. %. If the hydrogen content exceeds 10 atm. %, $SiH_2$ or $(SIH_2)_n$ bonds become predominant and, as a result, the number of dangling bonds increases, thus degrading the member's photoconductive properties, in which case, a photosensitive body having the desired characteristics cannot be obtained. If the hydrogen content is below 1 atm. %, hydrogen ions cannot compensate for the dangling bonds, thus resulting in reduced carrier mobility and lifetime.

Surface layer 24, formed on photoconductive layer 23, is made of μc-Si containing C, O, or N. When the surface layer is provided, the photoconductive layer can be protected from damage and its charging properties are improved, thus attracting charges onto the surface layer. Since the a-Si of the photoconductive layer has a relatively large refractive index of 3 to 4, light reflection easily occurs on its surface. If such light reflection occurs, the amount of light absorbed in the photoconductive layer is consequently reduced, thus increasing light loss. Light reflection can be prevented by forming the surface layer.

When at least one element selected from the group consisting of nitrogen N, carbon C, and oxygen O is doped in the μc-Si or a-Si, the dark resistance of the μc-Si or a-Si is increased, thus enhancing its photoconductive characteristics.

The concentration of nitrogen in the a-Si, μc-Si, and a-BN is preferably changed in the direction of the layer's thickness. Thereby, the bonding properties between the respective layers can be improved, and carrier transfer can be smooth.

Figure 2:
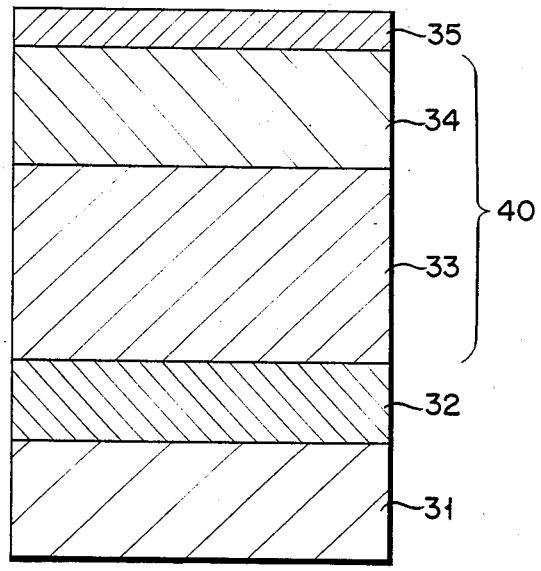
FIG. 2 is a sectional view showing a modification of FIG. 1.

FIG. 2 shows an embodiment of a function-separation type photoconductive layer wherein photoconductive layer 40 is divided into charge-generation layer 34 and charge-transfer layer 33. In this embodiment, a-BN barrier layer 32, charge-transfer layer 33 of a-Si or μc-Si, a-Si charge generation layer 34, and μc-Si surface layer 35 are sequentially formed on conductive substrate 31. Charge-generation layer 34 generates carriers upon irradiation of light. Charge-transfer layer 33 transfers carriers generated by charge-generation layer 34 to the conductive substrate, with high efficiency. When hydrogen is doped in charge-transfer layer 33, its carrier-transfer properties can be improved. When a Group III or V element of the periodic table is light-doped in charge-transfer layer 33, its dark resistance can be enhanced, thereby improving the charging properties.

A second embodiment of the present invention will now be described.

The second embodiment is substantially the same as the first embodiment, except that barrier layer 22 (FIG. 1) is formed of μc-Si. More specifically, barrier layer 22 is formed of μc-Si containing at least one element selected from among those of Group III or V of the periodic table. Barrier layer 22 preferably contains at least one element selected from C, O, and N.

Barrier layer 22 restricts the flow of carriers (electrons or holes) from conductive substrate 21 to photoconductive layer 23, thereby enhancing the charge-retaining function of the electrophotographic photosensitive body, and the charging properties thereof. In the Carlson process, when the surface of the photosensitive body is positively charged, a p-type barrier layer is provided in order to prevent electrons from being injected from the substrate to the photoconductive layer. When the surface of the photosensitive body is negatively charged, an n-type barrier layer is provided in order to prevent holes from being injected from the substrate to the photoconductive layer. The barrier layer preferably has a thickness of 0.01 to 10 μm.

In order to obtain p-type μc-Si, a Group III element of the periodic table, for example, boron B, aluminum Al, gallium Ga, indium In, thallium Ti, or the like is preferably doped. Alternatively, in order to obtain n-type μc-Si, a Group V element of the periodic table, for example, nitrogen N, phosphorus P, arsenic As, antimony Sb, bismuth Bi, or the like is preferably doped. When a p-type or n-type impurity is doped, carriers can then be prevented from being transferred from the substrate to the photoconductive layer.

When a band gap of μc-Si layer is widened, the μc-Si layer can be used as a barrier layer. This can be done by doping C, O, or N into the μc-Si layer. When a Group III or V element of the periodic table is doped in μc-Si containing C, O, or N, its blocking properties can be further enhanced. Further, when a μc-Si layer containing C, O, or N is stacked on a μc-Si layer containing a Group III or V element of the periodic table, a barrier layer having excellent charging and charge-retaining properties can be obtained.

Figure 3:
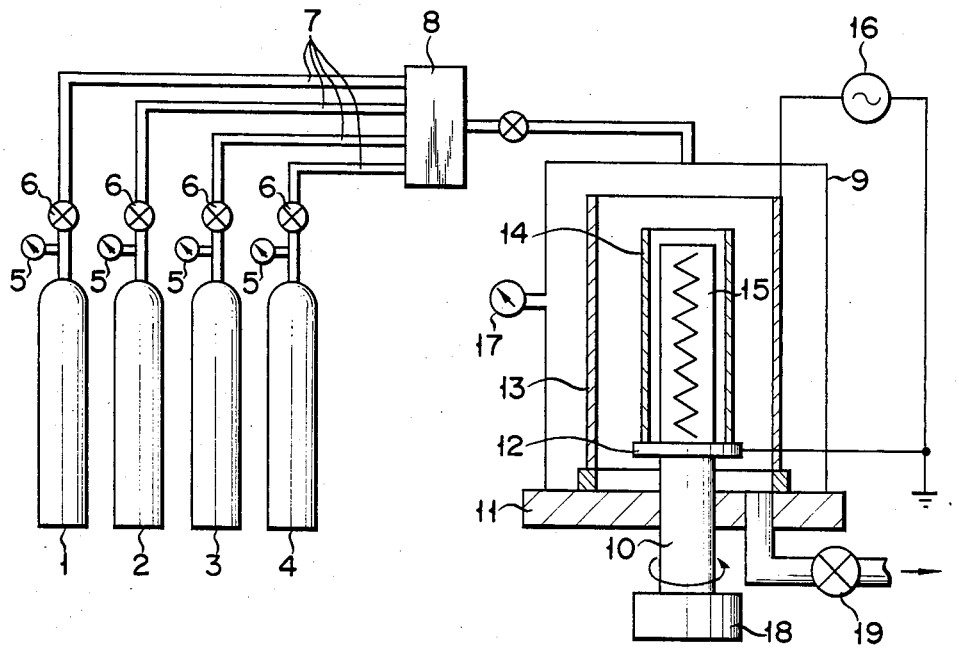
FIG. 3 is a diagram showing a manufacturing apparatus of an electrophotographic photosensitive member according to the present invention.

Description may now be made with reference to FIG. 3 of an electrophotographic photosensitive member embodying the present invention. Cylinders 1, 2, 3, 4 are respectively filled with any of the raw gases such as $SiH_4$, $B_2H_6$, $H_2$, He, Ar, $CH_4$, and $N_2$. The gases held in said gas cylinders 1, 2, 3, 4 are supplied to mixer 8 through the corresponding flow rate-adjusting valves 6 and pipes 7. The cylinders 1, 2, 3, 4 are respectively fitted with a pressure gage 5. The flow rate and mixing ratio of the raw gases supplied to mixer 8 can be adjusted by reading indications on the pressure gages 5 and valves 6. The gases mixed in mixer 8 are taken into reactor 9. Bottom board 11 of reactor 9 is fitted with horizontally rotatable shaft 10. Disc support 12 is fixed to the upper end of rotatable shaft 10, with the plane of said disc support 12 set perpendicular to said shaft 10. In reactor 9, cylindrical electrode 13 is erected on bottom board 11 with the center of said electrode 13 rendered concentric with said rotatable shaft 10. Draw-shaped main body 14 of a photosensitive member is mounted on said disc support 12 in a concentric relationship with said rotatable shaft 10. Heater 15 is located in said drum-shaped main body 14. High frequency power source 16 is connected between electrode 13 and drum-shaped main body 14 to supply high frequency current to them. Rotary shaft is driven by motor 18. Pressure within reactor 9 is watched by pressure gage 17. Reactor 9 is connected to suitable exhaust means, for example, a vacuum pump through gate valve 19.

When a photosensitive member is manufactured by an apparatus constructed as described above, drum-shaped main body 14 is first set in reactor 9. The interior of reactor 9 is evacuated to a lower pressure level than about 0.1 Torr with gate valve 19 left open. Thereafter, required reaction gases are taken into reactor 9 from cylinders 1, 2, 3, 4 at the predetermined mixing ratio. In this case, raw gases are carried into reactor 9 at such a flow rate as to set the interior pressure of reactor 9 at a level of 0.1 to 1 Torr. Thereafter, motor 18 is driven for the rotation of drum-shaped main body 14. Said main body 14 is heated to the predatermined temperature by heater 15 and a high frequency current is supplied between electrode 13 and drum-shaped main body 14 from high frequency power source 16 to generate glow discharge therebetween. As a result, a layer of a-Si, μc-Si or a-BN is deposited on drum-shaped main body 14. In this case, a layer of a-Si or μc-Si may contain an element such as N, C, or O by applying a raw gas such as $N_2O$, $NH_3$, $NO_2$, $N_2$, $CH_4$, $C_2H_4$, or $O_2$.

Doping of the layer μc-Si or a-Si with hydrogen, for example, by the glow discharge decomposition process may be carried out either by a glow discharge within reactor 9 of a mixture of a raw gas, such as $SiH_4$ or $Si_2H_6$ of the silane series and a carrier gas such as hydrogen or helium. Or said glow discharge decomposition may be made of a gaseous mixture of halogenizeo silicon, such as $SiF_4$ or $SiCl_4$ and hydrogen or helium. Or said glow discharge decomposition may be made of a gaseous mixture of a gas of the silane series and halogenized silicon. Further, it is possible to form a layer of μc-Si or a-Si by a physical process such as sputtering, in place of the glow discharge decomposition.

As mentioned above, the electrophotographic photosensitive member embodying the present invention offers the advantages that since the subject product can be manufactured within a closed syste, safety to the human body is ensured; the subject electrophotographic photosensitive member has a high resistance to heat, humidity and abrasion, and is negligibly deteriorated in property even when repeatedly applied over a long period of time, namely, if has a long effective life; since it is unnecessary to apply a long-wave sensitizer such as $GeH_4$, an exhausted gas-processing device is unnecessary; and the subject photosensitive member can be industrially manufactured with an exteremely high yield.

The present invention will now be described by way of examples.

EXAMPLE 1

After a conductive support was heated to and held at a temperature of about 300° C., $B_2H_6$ gas diluted to 10% concentration by nitrogen gas was fed in at 500 SCCM, and the interior of a reaction chamber was evacuated to 1.2 Torr by a mechanical booster pump and a rotary pump. 400 W RF power of 13.56 MHz was applied to generate $B_2H_6$ and $N_2$ plasmas between an electrode and a drum, thus forming a barrier layer of BN containing hydrogen.

The flow rate of $SiH_4$ gas was set to be 500 SCCM, that of the $B_2H_6$ gas, with respect to the flow rate of the $SiH_4$ gas, was set to $10^{-7}$, and both gases were then supplied into the reaction chamber. A 30-μm a-Si photoconductive layer was formed under the conditions of a reaction pressure of 1.2 Torr and RF power of 400 W.

Thereafter, a surface layer of μc-Si containing C, O, or N was formed.

An electrophotographic photosensitive member thus manufactured was mounted on a semiconductor laser printer, and an image was formed by the Carlson process. A clear, high-resolution image could be obtained on the surface of the photosensitive body, even at an exposure value of 25 erg/cm$^2$. When the reproducibility and stability were examined by repeating a copying operation, a very good transfer image could be obtained, and the drum had excellent durability, i.e., anti-corona, anti-humidity, and anti-wear properties, and the like.

EXAMPLE 2

A conductive support was heated and held at a temperature of about 300° C. $SiH_4$ gas, at a flow rate of 200 SCCM, and $B_2H_6$ gas, at a flow rate ratio of $10^{-8}$ with respect to the flow rate of the $SiH_4$ gas, were mixed, and the resulting mixture was supplied into a reaction chamber. Thereafter, the interior of the reaction chamber was evacuated by a mechanical booster pump and a rotary pump, thereby adjusting the reaction pressure therein to 1 Torr. 600 W RF power of 13.56 MHz was applied between an electrode and a drum, to generate $SiH_4$, $B_2H_6$, and $N_2$ plasmas thus forming a barrier layer of p-type μc-Si.

The flow rate of $SiH_4$ gas was set at 500 SCCM, that of the $B_2H_6$ gas was set at $10^{-7}$ with respect to the flow rate of the $SiH_4$ gas, and the resulting mixture was supplied into the reaction chamber. A 30-μm a-Si photoconductive layer was formed under the conditions of a reaction pressure of 1.2 Torr and RF power of 400 W.

Thereafter, a surface layer of μc-Si containing C, O, or N was formed following the same procedures as above.

The electrophotographic photosensitive member thus manufactured was mounted on a semiconductor laser printer, and an image was formed by the Carlson process. A clear image with high resolution can be obtained on the surface of the photosensitive member, even at an exposure value of 25 erg/cm$^2$. When the reproducibility and stability were examined by repeating a copying operation, a very good transfer image could be obtained, and the drum had excellent durability, i.e., anti-corona, anti-humidity, anti-wear properties, and the like.

EXAMPLE 3

After a conductive support was heated and held at a temperature of about 300° C., $SiH_4$ gas at a flow rate of 200 SCCM, $B_2H_6$ gas at a flow rate ratio of $10^{-5}$ with respect to the flow rate of the $SiH_4$ gas, and $N_2$ gas at a flow rate of 100 SCCM, were mixed and then supplied into a reaction chamber. Thereafter, the interior of the reaction chamber was evacuated by a mechanical booster pump and a rotary pump, thereby adjusting the reaction pressure therein to 1 Torr. 600 W RF power of 13.56 MHz was applied, between an electrode and a drum, to generate $SiH_4$, $B_2H_6$, and $N_2$ plasmas thus forming a barrier layer of μc-Si containing p-type N.

The flow rate of the $SiH_4$ gas was set at 500 SCCM, that of the $B_2H_6$ gas, with respect to the flow rate of the $SiH_4$ gas, was set at $10^{-7}$, and both gases were then supplied into the reaction chamber. A 30-μm a-Si photoconductive layer was formed under the conditions of a reaction pressure of 1.2 Torr and RF power of 400 W.

Thereafter, a surface layer of μc-Si containing C, O, or N was formed following the same procedure as above.

The electrophotographic photosensitive member thus manufactured was mounted on a semiconductor laser printer, and an image was formed by the Carlson process. A clear image with high resolution can be obtained on the surface of the photosensitive body, even at an exposure value of 25 erg/cm$^2$. When the reproducibility and stability were examined by repeating a copying operation, a very good transfer image could be obtained, and the drum had excellent durability, i.e., anti-corona, anti-humidity, and anti-wear properties, and the like.

According to the present invention, an electrophotographic photosensitive member which has high resistivity, excellent charging characteristics, and high photosensitivity in visible and near infrared light ranges, and which allows easy manufacture and has considerable practical advantages, can be obtained.

What is claimed is:

1. An electrophotographic photosensitive member comprising:

a conductive substrate;

a photoconductive layer of amorphous silicon containing hydrogen;

a barrier layer provided between the conductive substrate and the photoconductive layer; and a surface layer of microcrystalline silicon containing at least one element selected from the group consisting of nitrogen, carbon, and oxygen, formed on said photoconductive layer.

2. An electrophotographic photosensitive member according to claim 1, wherein said barrier layer is formed of amorphous boron nitride.

3. An electrophotographic photosensitive member according to claim 1, wherein said barrier layer is formed of microcrystalline silicon containing at least one element selected from among those of Group III or V one element selected from among those of Group III or V of the periodic table.

4. An electrophotographic photosensitive member according to claim 3, wherein said barrier layer contains at least one element selected from the group consisting of carbon, oxygen, and nitrogen.

5. An electrophotographic photosensitive member according to claim 1, wherein said photoconductive layer contains 1 to 10 atm. % of hydrogen.

6. An electrophotographic photosensitive member according to claim 1, wherein the thickness of said barrier layer lies in the range from almost 0.01 to 10 μm.

* * * * *